US007334437B2

(12) United States Patent
Meyer

(10) Patent No.: US 7,334,437 B2
(45) Date of Patent: Feb. 26, 2008

(54) DEVICE FOR ACCOMMODATING A PADLOCK

(75) Inventor: Mark Meyer, Greybull, WY (US)

(73) Assignee: Nancy Meyer, Socorro, NM (US)

( * ) Notice: Subject to any disclaimer, the term of this patent is extended or adjusted under 35 U.S.C. 154(b) by 0 days.

(21) Appl. No.: 11/266,711

(22) Filed: Nov. 3, 2005

(65) Prior Publication Data

US 2007/0095112 A1 May 3, 2007

(51) Int. Cl.
*E05B 67/38* (2006.01)

(52) U.S. Cl. ..... 70/54; 70/55; 70/417

(58) Field of Classification Search ..... 70/52, 70/54–56, 443, 448, 451, DIG. 34; D8/334–335
See application file for complete search history.

(56) References Cited

U.S. PATENT DOCUMENTS

| | | | | | |
|---|---|---|---|---|---|
| 3,858,419 | A | | 1/1975 | Hampton | |
| 4,218,902 | A | * | 8/1980 | Druschel | 70/55 |
| 4,224,813 | A | | 9/1980 | Hampton | |
| 4,226,100 | A | | 10/1980 | Hampton et al. | |
| 4,286,445 | A | * | 9/1981 | Sills | 70/55 |
| 4,297,861 | A | * | 11/1981 | Dykes | 70/55 |
| 4,317,344 | A | | 3/1982 | Barnard | |
| 4,534,190 | A | | 8/1985 | Stanich | |
| 4,651,543 | A | | 3/1987 | Heald et al. | |
| 4,905,486 | A | * | 3/1990 | Appelbaum | 70/54 |
| 5,003,795 | A | * | 4/1991 | Hoke | 70/55 |
| 5,033,279 | A | * | 7/1991 | Lebrecht | 70/55 |
| 5,156,029 | A | * | 10/1992 | Heald | 70/55 |
| 5,275,028 | A | | 1/1994 | Giarrante | |
| 5,638,707 | A | | 6/1997 | Gould | |
| 5,704,231 | A | | 1/1998 | Heald | |
| 5,761,935 | A | * | 6/1998 | Adelmeyer | 70/55 |
| D400,078 | S | | 10/1998 | Adelmeyer | |
| 6,192,721 | B1 | * | 2/2001 | Monteleone | 70/55 |
| 6,578,393 | B2 | | 6/2003 | Yarborought | |
| 6,813,914 | B2 | * | 11/2004 | Chen | 70/50 |
| D525,112 | S | * | 7/2006 | Butts et al. | D8/346 |
| 2002/0124603 | A1 | | 9/2002 | Yarborough | |

* cited by examiner

*Primary Examiner*—Patricia Engle
*Assistant Examiner*—Christopher Boswell
(74) *Attorney, Agent, or Firm*—Robert W. Becker; Robert W. Becker & Assoc.

(57) ABSTRACT

A device for accommodating a padlock, including two halves that each have a cavity and that are hingedly interconnected such that they are movable between an open position and a closed position. In the closed position the cavities mate to form an enclosure for accommodating a padlock. At least one of the halves has a cutout for receiving the shank of the padlock. A latching mechanism retains the two halves in the closed position to contain the padlock body within the enclosure formed by the cavities.

13 Claims, 5 Drawing Sheets

DEVICE FOR ACCOMMODATING A PADLOCK

BACKGROUND OF THE INVENTION

The present invention relates to a device for accommodating a padlock, and in particular the body of such a padlock.

When used out of doors, padlocks are frequently exposed to the elements, including rain, snow, dust, and other dirt and contamination. Under such adverse conditions, the body of the padlock, be it a key or combination padlock, can become clogged, rusty or otherwise inoperable.

It is therefore an object of the present invention to provide a device for protecting the padlock from the elements.

BRIEF DESCRIPTION OF THE DRAWINGS

This object, and other objects and advantages of the present application, will appear more clearly from the following specification in conjunction with the accompanying schematic drawings, in which.

SUMMARY OF THE INVENTION

Figure 1:
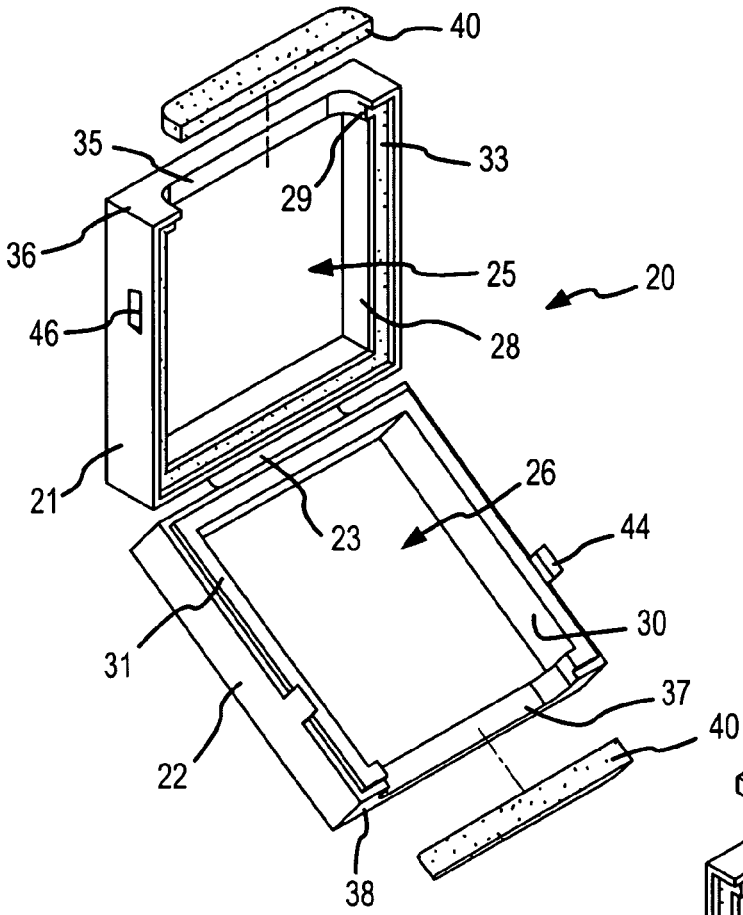
FIGS. 1 & 2 are perspective views of an exemplary embodiment of a device for accommodating a padlock.

The padlock accommodating device of the present application comprises first and second halves, each having a cavity, with the halves being interconnected such that they are movable between an open position and a closed position, wherein in the closed position the first and second cavities mate to form an enclosure for accommodating a padlock. At least one of the halves has a cutout for receiving the shank of the padlock. Furthermore, means are provided to latch the two halves together in the closed position to contain the padlock body within the enclosure.

The padlock accommodating device of the present application provides protection for the body of a padlock after the padlock has been attached to a hasp, chain, etc. by isolating the body of the padlock from the portion of the shank that is passed through the hasp or chain. In particular, the two halves of the device, which form a slot through which the shank of the padlock is passed, isolate the body of the lock from the outside, thus protecting the padlock body from the elements. The padlock accommodating device can be open or closed frequently, so that it can be used on locks that have to be frequently accessed. However, the padlock accommodating device of the present application also protects infrequently accessed padlocks for an extended period of time. Thus, the device of the present application protects the operability of a padlock that is left unattended in a harmful environment.

Further specific features of the present application will be described in detail subsequently.

DESCRIPTION OF SPECIFIC EMBODIMENTS

Referring now to the drawings in detail, the drawings show one exemplary embodiment of the padlock accommodating device of this application, with this device being designated generally by the reference numeral 20.

Figure 3:
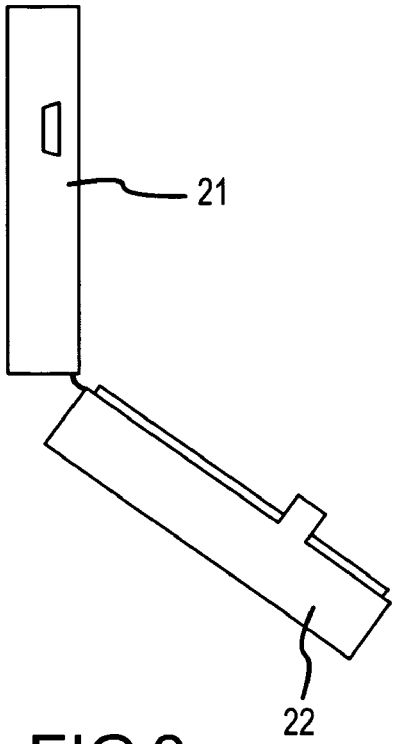
FIGS. 3 to 5 show the padlock in an open position, a partially closed or open position, and a closed position.
Figure 4:
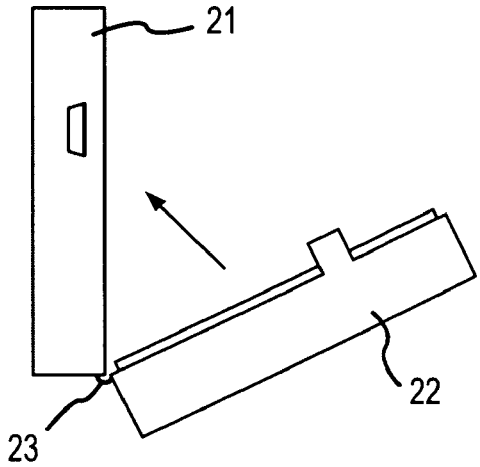
Figure 5:
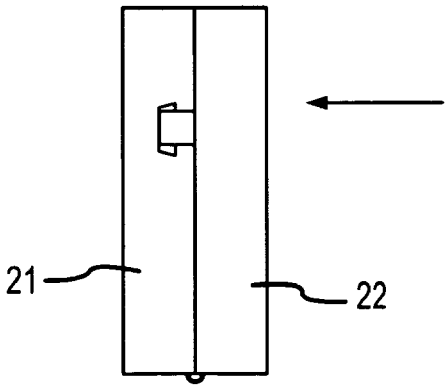

The padlock accommodating device 20 comprises a first half 21 and a second half 22, which are interconnected by a hinge 23. Although any suitable hinge means can be used to interconnect the first half 21 and the second half 22, in the illustrated embodiment the hinge 23 is a thin flexible strip, in particular made of the same plastic material as are the first and second halves 21 and 22, but merely much thinner in order to provide the necessary flexibility in order to effect a hinged connection between the first and second halves. The functioning of the hinge 23 can be seen in FIGS. 3 to 5, wherein FIG. 3 shows the device in a mostly open position, whereas FIG. 4 shows the device in a partially closed or open position, and FIG. 5 shows the device in a closed position.

Figure 2:
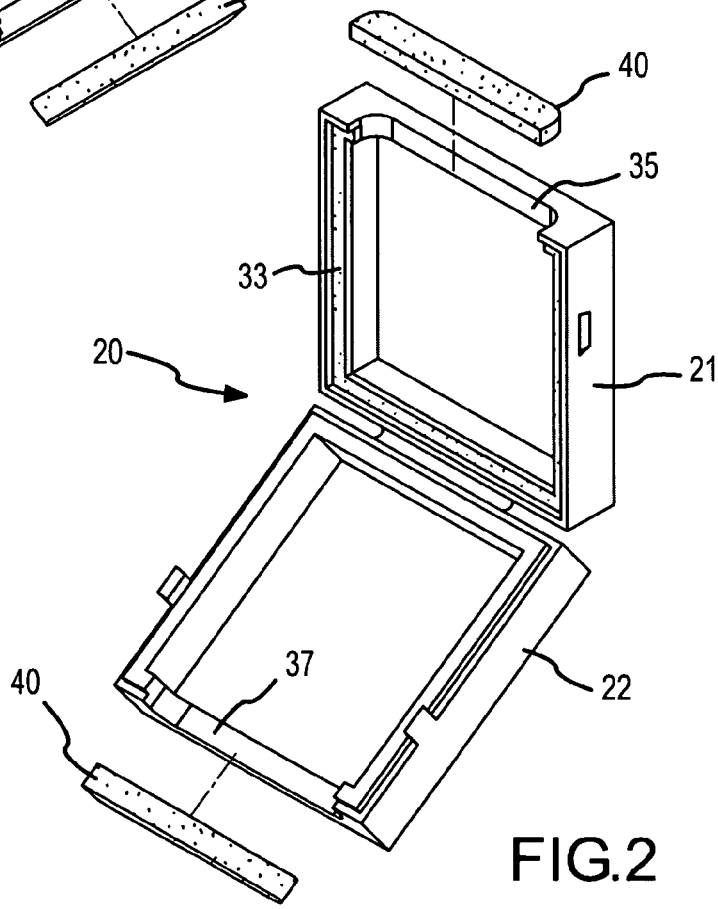

As can be seen best in FIGS. 1 and 2, the first half 21 of the device 20 is provided with a first cavity 25, while the second half 22 is provided with a second cavity 26. When the padlock accommodating device 20 is in a closed position, in other words, when the first and second halves 21 and 22 are placed together as shown in FIGS. 5-7 and 8-11, the cavities 25 and 26 mate with one another and thereby form an enclosure for accommodating the body of a padlock. In order in the closed position to protect the padlock body from the elements, the padlock accommodating device 20 of the present application is provided with special sealing means. In particular, the inwardly facing portions 28 of the sides of one of the halves, in the illustrated embodiment the first half 21, are recessed, as indicated by the reference numeral 29. The inwardly facing portions 30 of the opposite or facing surface (when the padlock accommodating device 20 is in the closed position) is provided with a projecting lip 31 that in the closed position of the device 20 mates with the recess 29 of the first half 21. It is to be understood that although the recess 29 is shown in the first half 21, and the projecting lip 31 is shown in the second half 22, it would also be possible to provide the second half 22 with the recess 29 and the first half 21 with the projecting lip 31. The mating of the recess 29 and the projecting lip 31 can be clearly seen from FIG. 11.

Although the configuration of recess 29 and projecting lip 31 may by itself be sufficient to protect the enclosure formed by the cavities 25 and 26 from the elements, a seal or gasket 33 can be disposed in the recess 29. To prevent the gasket 33 from accidentally falling out of the recess 29, it could be glued into the recess. In addition, to maximize the sealing effect of the gasket 33, the thickness of the gasket can be slightly greater than the gap between the recess 29 and the projecting lip 31 so that when the padlock accommodating device 20 is closed, the projecting lip 31 will compress the gasket 33 in the recess 29 (see FIG. 11). The gasket 33 can, by way of example, be a closed-cell foam seal.

To accommodate the arms of the shank of a padlock placed into the enclosure formed by the cavities 25 and 26 when the padlock accommodating device 20 is closed, a first cutout 35 is provided on that side 36 of the first half 21 that is opposite the hinge 23, and a second cutout 37 is provided on that side 38 of the second half 22 that is opposite the hinge 23. When the padlock accommodating device 20 is closed, the first and second cutouts 35 and 37 provide a slot through which the arms of the shank of the padlock can pass.

It should also be noted that whereas in the illustrated embodiment each of the first and second halves 21 and 22 are provided with respective cutouts 35 and 37 that mate together to form a slot, such a slot could be provided in just one of the halves 21 and 22. In such a case, that half 21 or 22 that is provided with the slot would be larger, and hence have a larger cavity, than would the other half.

Figure 6:
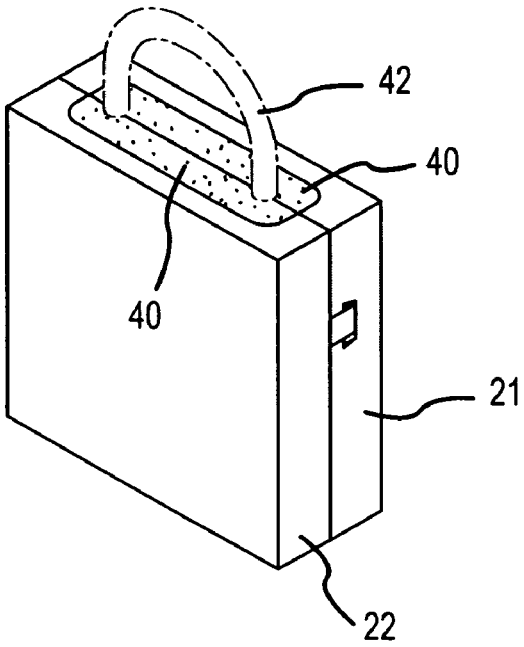
FIGS. 6 & 7 show the device in a closed position encasing a padlock.
Figure 7:
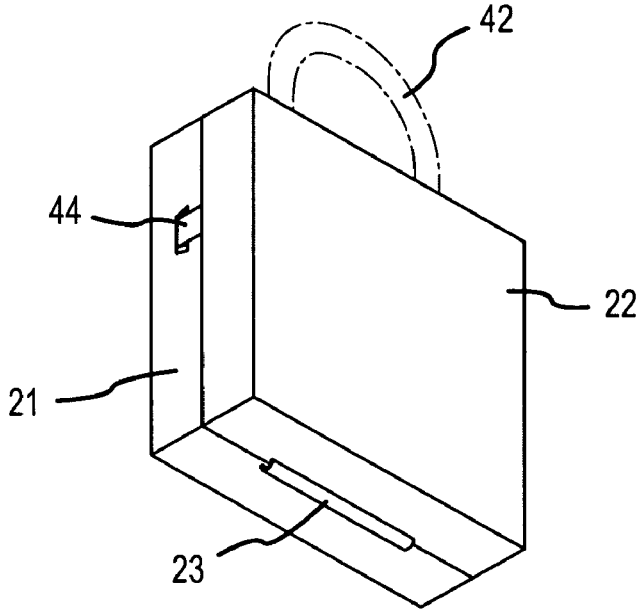
Figure 10:
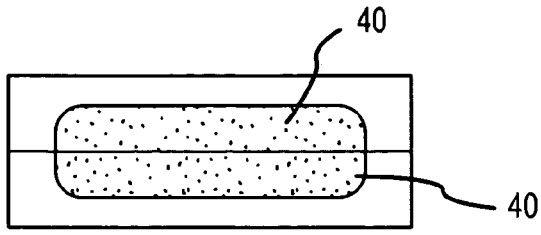
FIGS. 8-11 show various closed views of the device.
Figure 8:
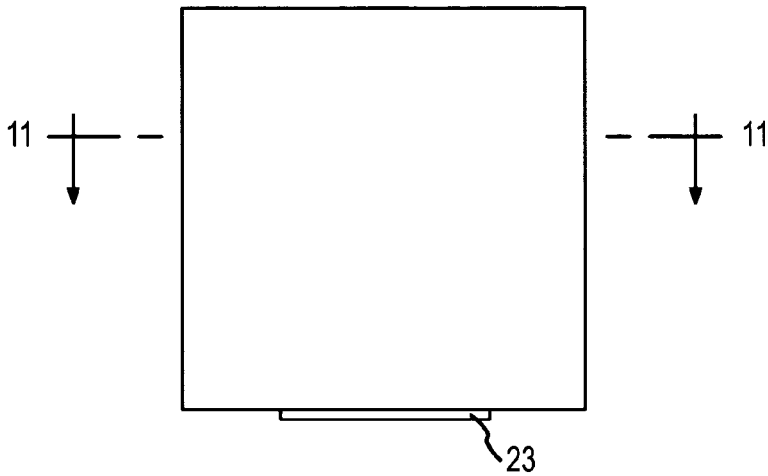
Figure 9:
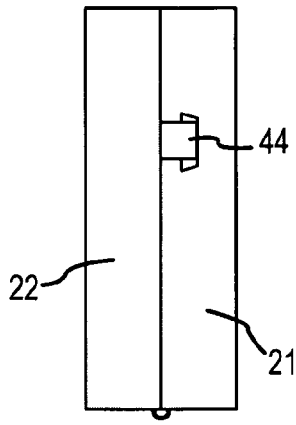
Figure 11:
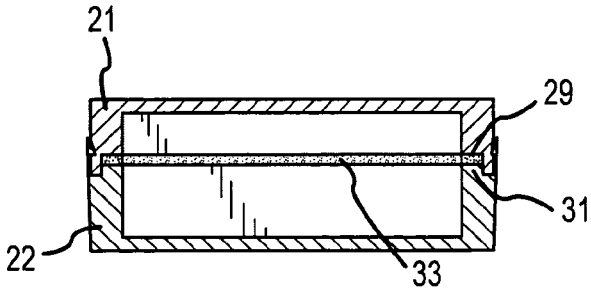

Again, in order to protect the enclosure formed by the cavities 25 and 26 from the elements, the cutouts 35 and 37 could each be provided with a respective seal 40, such as a closed-cell foam seal. The seals 40 can be secured in their cutouts 35 or 37 by being glued therein. The seals 40 completely fill their respective cutouts, and could even be slightly larger, so that when the padlock accommodating device 20 is closed, the seals 40 are compressed against one another to effectuate a tight seal. In either case, the seals 40 are flexible enough to accommodate the arms of the shank 42 of a padlock, as shown in FIG. 6.

Figure 12:
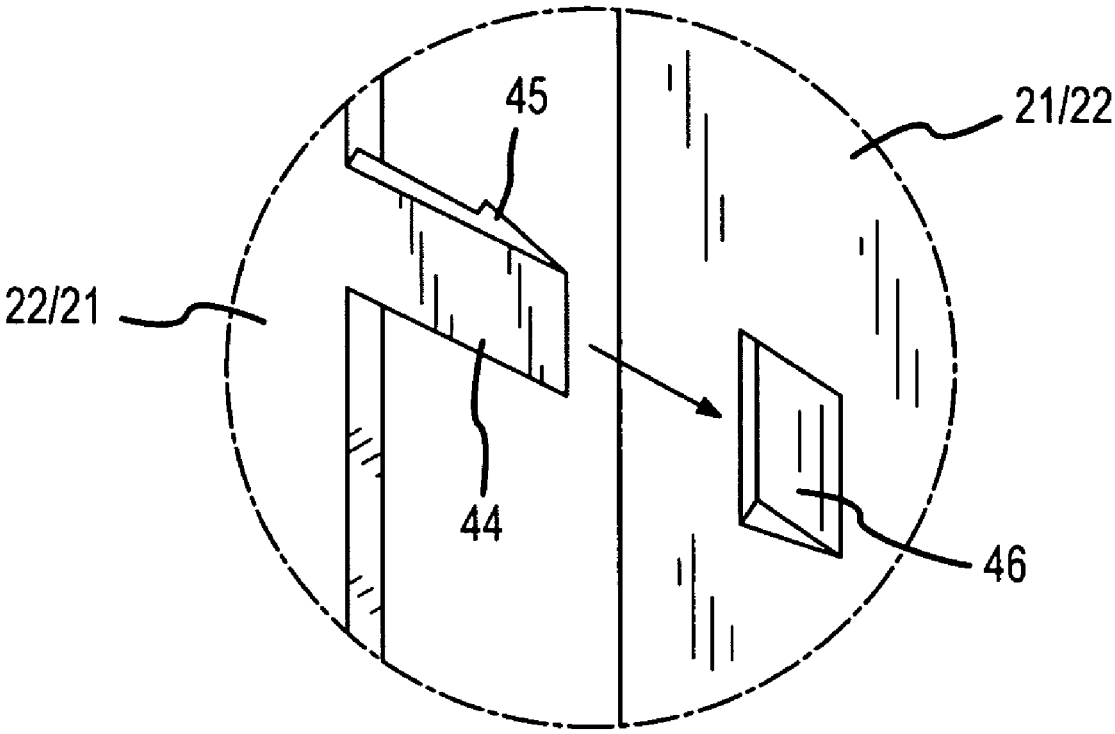
FIG. 12 is an enlarged view of the latching means of the device.

In order to retain the padlock accommodating device 20 in a closed position, latching means are provided, with an enlarged view of an exemplary latching means being shown in FIG. 12. In particular, one of the halves 21 or 22, and in the illustrated embodiment the second half 22, is provided with at least one arm or tab 44, which is provided with a detent or projecting portion 45 that is adapted to catch in a corresponding recess 46, especially an undercut recess, provided in the other half 21. The tab or tabs 44 are somewhat flexible, so that when the padlock accommodating device 20 is closed the tabs 44 slide over the outer surface of the half of the device that is provided with the recesses 46, and the detents 45 catch in such recesses 46. Due to the flexibility of the tabs 44, the detents 45 can be readily released from their recesses 46 in order to open the padlock accommodating device 20. Although two latching means or mechanisms have been shown in the illustrated embodiment, it would also be possible to provide just one latching mechanism, or more than two latching mechanisms. In addition, the latching mechanism could be provided in any of the sides of the halves 21 and 22 of the device 20, with the exception of the side on which the hinge 23 is provided. Furthermore, any other suitable latching means could also be used.

Although the gasket 33 has been illustrated as being disposed in the recess 29, with a corresponding projecting lip 31 mating therewith to effectuate a seal, it is to be understood that the gasket 33 could also project beyond the surface in which it is disposed and extend into a corresponding recess provided in the other half of the padlock accommodating device 20.

The first half 21, the second half 22, including the tabs 44, and the hinge 23 can all be injection molded as a single monolithic piece.

The present invention is, of course, in no way restricted to the specific disclosure of the specification and drawings, but also encompasses any modifications within the scope of the appended claims.

I claim:

1. A device for accommodating a padlock, comprising:

a first half having a first cavity;

a second half having a second cavity, wherein said first and second halves are hingedly interconnected such that said first and second halves are movable between an open position and a closed position, wherein in said closed position said first and second cavities of said first and second halves mate to form an enclosure for accommodating a body of the padlock, wherein each of said first and second halves is provided with a single cutout portion, and wherein said first and second halves are hingedly interconnected such that in said closed position said. cutout portions of said first and second halves together line up to form a single slot for receiving the arms of a shank of the padlock; and means to latch said first and second halves together in said closed position to contain the padlock body within said enclosure.

2. A device according to claim 1, wherein said first and second halves are hingedly interconnected by means of a flexible strip that interconnects said first and second halves remote from said at least one cutout.

3. A device according to claim 2, wherein said first and second halves and said flexible strip are a single monolithic component.

4. A device according to claim 1, wherein said at least one cutout is substantially completely filled with a compressible sealing member.

5. A device according to claim 4, wherein one of facing sides of said first and second halves is provided with a compressible seal in an area other than said cutout, and wherein the other of said facing sides is provided with a lip or a recess for engaging or receiving said seal.

6. A device according to claim 5, wherein said one facing side is provided with a recess for said seal.

7. A device according to claim 1, wherein each of said cutouts is substantially completely filled with a compressible sealing member.

8. A device according to claim 1, wherein one of facing sides of said first and second halves is provided with a compressible seal in an area other than said cutout, and wherein the other of said facing sides is provided with a lip or a recess for engaging or receiving said seal.

9. A device according to claim 8, wherein said one facing side is provided with a recess for said seal.

10. A device for accommodating a padlock, comprising:

a first half having a first cavity;

a second half having a second cavity, wherein said first and second halves are hingedly interconnected such that said first and second halves are movable between an open position and a closed position, wherein in said closed position said first and second cavities of said first and second halves mate to form an enclosure for accommodating a body of the padlock, wherein at least one of said first and second halves has a single cutout for receiving a shank of the padlock, and wherein said cutout is opposite from said hinged interconnection; and means to latch said first and second halves together in said closed position to contain the padlock body within said enclosure, wherein said means to latch said first and second halves together comprises at least one externally disposed, non-rotatable tab having a detent in the form of a projecting portion, on one of said halves, and at least one undercut recess, on the other of said halves, for receiving said projecting portion in a catching manner to form a snap fit.

11. A device according to claim 10, wherein said tab is a flexible tab to facilitate catching or snapping of said projecting portion in said recess.

12. A device according to claim 10, wherein both said tab and said recess are disposed on outer surfaces of said first and second halves.

13. A device for accommodating a padlock, comprising:

a first half having a first cavity;

a second half having a second cavity, wherein said first and second halves are hingedly interconnected such that said first and second halves are movable between an open position and a closed position, wherein in said closed position said first and second cavities of said first and second halves mate, along a plane that is parallel to a plane of a shank of the padlock, to form an enclosure for accommodating a body of the padlock, and wherein at least one of said first and second halves has a single cutout for receiving the shank of the padlock; and means to latch said first and second halves together in said closed position to contain the padlock body within said enclosure.

* * * * *